United States Patent [19]

Maskasky

[11] 4,142,900

[45] * Mar. 6, 1979

[54] CONVERTED-HALIDE PHOTOGRAPHIC EMULSIONS AND ELEMENTS HAVING COMPOSITE SILVER HALIDE CRYSTALS

[75] Inventor: Joe E. Maskasky, Rochester, N.Y.

[73] Assignee: Eastman Kodak Company, Rochester, N.Y.

[ * ] Notice: The portion of the term of this patent subsequent to Jun. 13, 1995, has been disclaimed.

[21] Appl. No.: 770,242

[22] Filed: Feb. 18, 1977

[51] Int. Cl.[2] ..... G03C 1/02

[52] U.S. Cl. ..... 96/94 R; 96/114.1; 96/121

[58] Field of Search ..... 96/94 R, 121, 114.1

[56] References Cited

U.S. PATENT DOCUMENTS

| | | | |
|---|---|---|---|
| 2,592,250 | 4/1952 | Davey et al. | 96/94 R |
| 3,622,318 | 11/1971 | Evans | 96/22 |
| 3,656,962 | 4/1972 | Levy | 96/3 |
| 3,804,629 | 4/1974 | Hammerstein et al. | 96/94 R |
| 3,852,066 | 12/1974 | Levy | 96/94 R |
| 3,852,067 | 12/1974 | Levy | 96/94 R |
| 4,094,684 | 6/1978 | Maskasky | 96/100 R |

FOREIGN PATENT DOCUMENTS

| | | | |
|---|---|---|---|
| 505012 | 8/1930 | Fed. Rep. of Germany | 96/94 R |
| 1027146 | 4/1966 | United Kingdom | 96/94 R |

OTHER PUBLICATIONS

T. H. James, The Theory of the Photographic Process, 4th Ed., Chapter 2, Gelatin (p. 51).

Product Licencing Index, vol. 92, Dec. 1971, #9232, p. 108, paragraph VIII, "Vehicles".

Photographic Emulsion Chemistry-Duffin, pp. 61 and 62, ©1966, Focal Press, N.Y.

Steigmann, Photographische Industrie, 34: 764, 766, 872, Jul. 8-Aug. 5, 1933.

Photographic Emulsion Chemistry-Duffin, pp. 60 to 65, ©1966, Focal Press, N.Y.

*Primary Examiner*—J. Travis Brown

*Assistant Examiner*—L. Falasco

*Attorney, Agent, or Firm*—Carl O. Thomas

[57] ABSTRACT

Converted-halide photographic emulsions and elements are disclosed containing composite silver halide crystals. The composite crystals are comprised of multifaceted, radiation-sensitive silver iodide crystals. Silver halide crystals at least partially converted from silver chloride to silver bromide form epitaxial junctions with the silver iodide crystals. At least half of the facets of the silver iodide crystals are substantially free of epitaxial silver chloride, and the converted silver halide crystals are limited to less than 75 mole percent, based on the total silver halide forming the composite crystals.

19 Claims, 4 Drawing Figures

FIG. 1
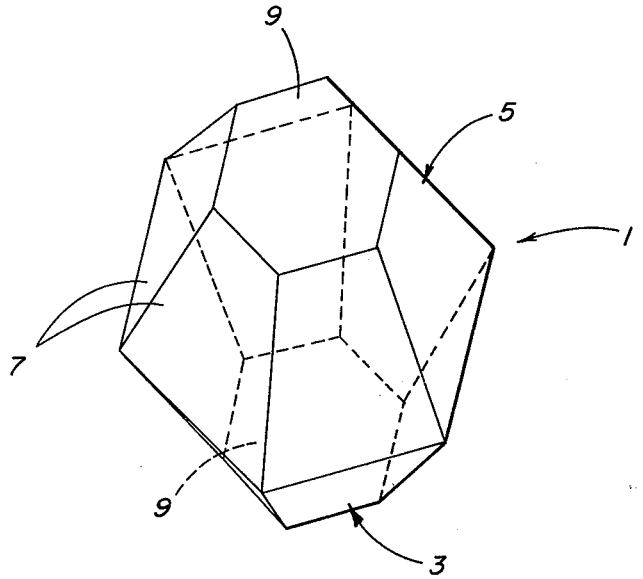
FIG. 2
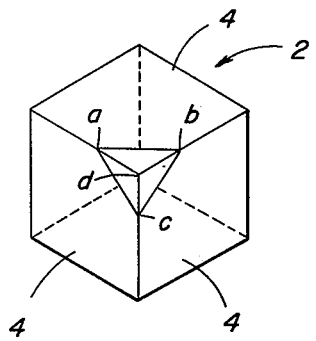
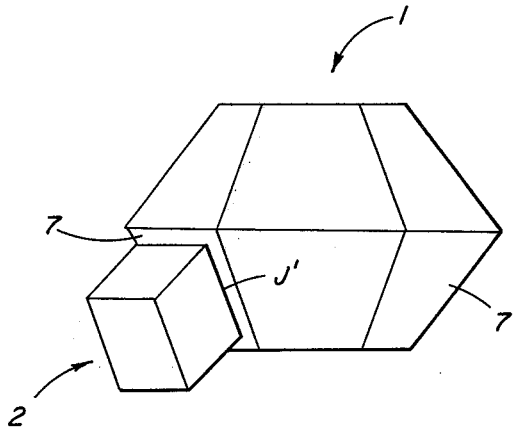
FIG. 4
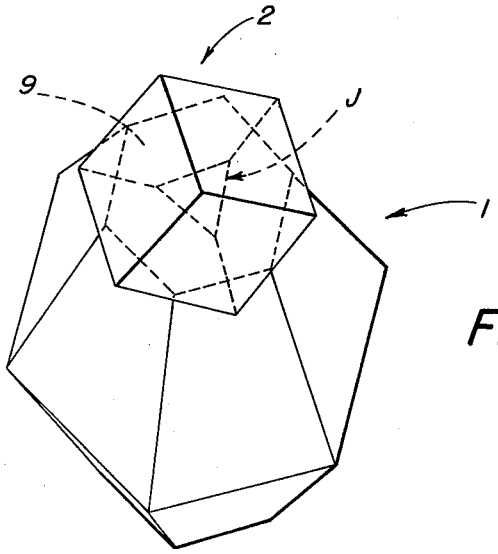
FIG. 3

CONVERTED-HALIDE PHOTOGRAPHIC EMULSIONS AND ELEMENTS HAVING COMPOSITE SILVER HALIDE CRYSTALS

My invention relates to converted-halide photographic emulsions and elements. More specifically, my invention relates to photographic emulsions and elements incorporating silver iodide crystals and converted-halide crystals in a composite grain structure.

It is known in photography that silver halide grains are useful in forming developable latent images when struck by actinic radiation, such as electromagnetic radiation, neutrons, beta particles or the like. Many patents refer to the use of silver bromide, silver chloride, silver iodide, silver bromoiodide, silver chloroiodide, silver chlorobromide and silver chlorobromoiodide, reflecting an intent to include all photographically useful silver halides.

Such teachings should not, however, be misconstrued to imply that all silver halides have similar properties or that all possible combinations of these halides are thereby disclosed. In Mees and James, *The Theory of the Photographic Process,* the Macmillan Company, New York, Third Edition, 1966, Chapters 1 and 2 are directed to the properties of silver halides and silver halide grain structures. As these chapters make abundantly clear the physical properties of silver halides differ significantly. Further, the discussion, such as that appearing under the heading "Precipitation of Iodide with Silver Bromide," pp. 34 and 35, further makes apparent that terms such as "silver bromoiodide" are generic in character and in fact encompass an array of variant crystallographic structures.

In considering merely the light absorption characteristics of silver halides one might assume silver iodide emulsions to be most commonly employed in photography, since silver iodide exhibits an absorption peak at about 420 nm while silver chloride and silver bromide both exhibit absorption peaks in the ultraviolet region of the spectrum and only toe absorptions within the visible spectrum.

As a matter of fact, pure silver iodide emulsions have found very limited photographic utility. One distinctive property of pure silver iodide grains is their limited solubility. Silver chloride has a solubility product constant which is approximately six (6) orders of magnitude larger than that of silver iodide, and silver bromide has a solubility product constant which is approximately three (3) orders of magnitude larger than that of silver iodide. Thus, development of silver iodide emulsions is difficult. To account further for the limited utility of silver iodide it has been theorized that, while photons striking silver iodide crystals form hole-electron pairs, the recombination of the hole-electron pairs occurs more readily than in silver bromide and silver chloride. Thus, in the absence of special techniques, little, if any, developable latent image is retained in the light exposed silver iodide grains.

Most commonly, silver iodide has been employed in proportions of less than about 10 percent by weight in photographic emulsions containing silver bromoiodide or silver chlorobromoiodide grains. Such silver halide grains have been found to be readily developable and capable of attaining high photographic speeds.

Unless modified, silver halide emulsions produce surface latent images. That is, the latent image which is formed can be developed using a developer solution which is incapable of obtaining access to the interior of the silver halide grain structure. One technique for producing silver halide grains which are capable of forming an internal latent image is to incorporate within the silver halide grain as it is being formed an internal dopant, such as a chemical sensitizer or a metal ion. Evans U.S. Pat. No. 3,761,276, issued Sept. 25, 1973, is illustrative of internal doping of silver halide grains.

An alternative technique for producing silver halide grains capable of forming predominantly internal latent images is to produce internal physical dislocations in the silver halide crystal structure. One approach for accomplishing this is to provide a converted halide grain structure. In a converted halide grain structure a silver salt, such as silver chloride, initially is formed. Thereafter another halide, bromide or a mixture of bromide and iodide, entirely or at least partially replaces the chloride atoms in the crystal lattice. The resulting crystal structure preferentially form internal latent images because of the many crystal faults lying within the grain which can act as traps for photon generated electrons. The crystal faults are produced by disparities in size between the chlorine atoms which initially formed the crystal lattice with silver and the much larger bromine and iodine atom which take their place in conversion. Converted halide emulsions are disclosed, for example, by Davey and Knott U.S. Pat. No. 2,592,250, issued Apr. 8, 1952, and Evans U.S. Pat. No. 3,622,318, issued Nov. 23, 1971. The term "converted-halide" in referring to silver halide grains is employed herein as a word of art and denotes silver halide grains prepared by forming an emulsion of silver salt grains consisting at least partly of a silver salt more soluble in water than silver bromide and "converting" at least a portion of such grains to silver bromide or silver bromoiodide salts.

The concept of combining halides to achieve the advantages of separate silver halides within a single silver halide grain structure has been recognized in the art. Klein et al British Pat. No. 1,027,146 discloses a technique for forming composite silver halide grains. Klein et al forms silver halide core or nuclei grains and then proceeds to cover them with one or more contiguous layers of silver halide. The composite silver halide grains contain silver chloride, silver bromide, silver iodide or mixtures thereof. For example, a core of silver bromide can be coated with a layer of silver chloride or a mixture of silver bromide and silver iodide, or a core of silver chloride can have deposited thereon a layer of silver bromide. In depositing silver chloride on silver bromide Klein et al teaches obtaining the spectral response of silver bromide and the developability characteristics of silver chloride.

Beckett et al U.S. Pat. No. 3,505,068, issued Apr. 7, 1970, uses the techniques taught by Klein et al to prepare a slow emulsion layer to be employed in combination with a faster emulsion layer to achieve lower contrast for a dye image. The silver halide grains employed in the slow emulsion layer have a core of silver iodide or silver haloiodide and a shell which is free of iodide composed of, for example, silver bromide, silver chloride or silver chlorobromide.

Steigmann German Pat. No. 505,012, issued Aug. 12, 1930, teaches forming silver halide emulsions which upon development have a green tone. This is achieved by precipitating silver halide under conditions wherein potassium iodide and sodium chloride are introduced in succession. Examination of emulsions made by this process indicates that very small silver iodide grains, substantially less than 0.1 micron in mean diameter, are formed. Further, separate silver chloride grains are formed. Increasing the silver iodide grain size results in a converion of the desired green tone to a brown tone. An essentially cumulative teaching by Steigmann appears in *Photographische Industrie,* "Green—and Brown-Developing Emulsions, Vol. 34, pp. 764, 766 and 872, published July 8 and Aug. 5, 1938.

Levy U.S. Pat. No. 3,656,962, issued Apr. 18, 1972, and U.S. Pat. Nos. 3,852,066 and 3,852,067, issued Dec. 1974, teach the incorporation of inorganic crystalline materials into silver halide emulsions. It is stated that the intimate physical association of the silver halide grains and the inorganic crystals can alter the sensitivity of the silver halide emulsion to light.

My photographic emulsions and elements employ a novel composite silver halide crystal structure which combines the radiation-response of silver iodide with the known characteristics of converted-halide emulsions. As an illustration, I have discovered that, when composite silver halide grains according to my invention are coated in an emulsion layer, exposed to radiation within the portion of the visible spectrum where silver iodide is capable of absorption, but other photographic silver halides exhibit little absorption, and developed under conditions which permit development of converted-halide grains, I am able to produce photographic images. I accomplish this even though similarly prepared, exposed and processed photographic elements having emulsions of silver iodide grains or converted-halide silver halide grains fail to produce photographic images or produce comparatively low density or low speed photographic images.

I have further found a way of achieving this desirable combination of silver iodide and converted-halide silver halide properties using a limited amount of silver chloride. More specifically, I have avoided any necessity of shelling silver iodide grains with silver chloride. Thus, I have avoided the very large chloride to iodide ratios which would be required in attempting to shell silver iodide grains with silver chloride or dissimilar crystal habit. I have found further that by minimizing the silver chloride to silver iodide ratios required in composite grains, I am able to achieve higher speed to silver ratios than heretofore possible with shelled grain structures. Still further, I am able to achieve photographic speeds which are comparable to those of silver bromoiodide emulsions.

My photographic emulsions and elements are capable of liberating relatively large quantities of iodide ion upon development, and I am thereby able most advantageously to achieve photographic effects dependent on iodide ion release. Specifically, I have found that the photographic emulsions and elements of my invention exhibit highly favorable interimage and edge effects. I can also employ the iodide ions released during development to poison heterogeneous catalyst surfaces, such as those employed in redox amplification reactions of oxidizing agents, e.g., cobalt, hexammine or hydrogen peroxide, and dye-image-generating reducing agents, e.g., color-developing agents and redox dye-releasers (employed in combination with electron transfer agents).

An additional advantage of my invention is that my photographic elements and emulsions can be developed to produce a heterogeneous catalyst image—i.e. a silver image—for use in a redox amplification reaction. This is particularly surprising, since, under modified conditions, I can employ the iodide ions released during development to poison the silver image as a redox amplification catalyst.

In one aspect, my invention is directed to a converted-halide photographic emulsion comprised of a photographic vehicle as a continuous phase and, as a discrete phase, radiation-sensitive composite silver halide crystals. The composite crystals are comprised of multifaceted, radiation-receptive silver iodide crystals and converted-halide silver halide crystals at least partially converted from silver chloride to silver bromide forming epitaxial junctions with the silver iodide crystals. At least half of the facets of the silver iodide crystals are substantially free of epitaxial silver chloride. The converted-halide silver halide crystals are limited to less than 75 mole percent, based on the total silver halide forming the composite crystals.

In another aspect my invention is directed to an improvement in a photographic element having a support and, coated on the support, a radiation-sensitive layer including radiation-sensitive silver halide crystals. At least a portion of the radiation-sensitive silver halide crystals are composite silver halide crystals comprised of a multi-faceted radiation-receptive silver iodide crystals and converted-halide silver halide crystals at least partially converted from silver chloride to silver bromide forming epitaxial junctions with the silver iodide crystals. At least half of the facets of the silver iodide crystals are substantially free of epitaxial silver chloride. The converted-halide silver halide crystals are limited to less than 75 mole percent, based on the total silver halide forming the composite crystals.

My invention may be more fully appreciated by reference to the following detailed description considered in conjunction with the drawings, in which FIGS. 1 through 4 are illustrations of silver halide crystals. The crystals are depicted substantially enlarged to facilitate viewing.

The photographic emulsions employed in the practice of my invention contain composite crystals of silver iodide and converted-halide silver halides. One portion of each composite crystal is a conventional silver iodide crystal. In a common, preferred form the silver iodide crystal is a beta-phase silver iodide crystal (a hexagonal structure of wurtzite type). Such crystals are truncated hexagonal bipyramids. A regular truncated hexagonal bipyramid 1 is shown in FIG. 1. As is apparent from the figure, the crystal can be resolved into fused truncated hexagonal pyramids 3 and 5 sharing a common base. Each truncated pyramid then presents externally six lateral facets 7 and a truncating facet 9. Most commonly silver iodide emulsions contain beta-phase silver iodide crystals or mixtures of beta-phase silver iodide crystals with minor proportions of gamma-phase silver iodide crystals (face-centered cubic structures of zincblende type).

A second portion of each composite crystal is produced from a cubic silver chloride crystal. A cubic silver chloride crystal 2 is shown in FIG. 2. The cubic crystal presents six quadralateral crystal facets 4. The points a, b and c lying on intersecting edges of the cubic crystal define a triangular plane intersecting the cube. The intersecting plane is a 111 crystal plane. All of the points a, b and c are equidistant from the point of intersection d of the converging edges on which points a, b and c lie.

A typical parent composite crystal configuration for producing the emulsions of my invention is shown in FIG. 3. The composite crystal is comprised of a truncated hexagonal bipyramid beta-phase silver iodide crystal 1 with which a cubic silver chloride crystal 2 form an epitaxial junction J. The junction is formed by a truncating facet 9 of the silver iodide crystal, which forms a 001 crystal plane of the silver iodide crystal. The spacing of iodide and silver atoms in a 001 plane approximates (within about 16 percent) the spacing of silver and chloride atoms in the 111 crystal plane of the cubic silver chloride crystal. I believe this explains the observed epitaxial growth of a cubic silver chloride crystal at the truncating facet 9 of the silver iodide crystal.

In viewing photomicrographs of the grains of parent composite emulsions used to form the composite converted-halide emulsions of this invention the composite structure shown in FIG. 3 is quite common, usually predominant. A common variation, which may be predominant, depending upon the ratio of silver chloride to silver iodide, is for a second silver chloride cubic crystal to be identically associated with the remaining truncating facet 9 of the silver iodide crystal.

In FIG. 4 another variant form of the composite crystals of the parent emulsion is shown. In this figure the truncated hexagonal bipyramid silver iodide crystal 1 forms an epitaxial junction J' with a cubic silver chloride crystal 2. In this instance the junction is formed by one of the crystal facets 4 of the cubic silver chloride crystal and one of the lateral facets 7 of the silver iodide crystal. This crystal configuration accounts for only a minor proportion of the composite crystals present and is believed to represent a less crystallographically favored epitaxial arrangement of the silver iodide and silver chloride crystals. In photomicrographs I have observed silver chloride crystals to be epitaxially associated with both a truncating facet and a lateral facet of a single silver iodide grain, particularly where a high ratio of chloride to iodide is employed. Generally the parent emulsions as initially prepared can contain a mixture of all of the above-mentioned variant structural forms of the composite crystals of silver chloride and silver iodide.

The parent emulsion described above is more fully described in my copending, commonly assigned U.S. Pat. No. 4,094,684, titled PHOTOGRAPHIC EMULSIONS AND ELEMENTS, the disclosure of which is here incorporated by reference. The emulsions of this invention differ from those of the parent emulsions (i.e., from those of my copending patent application) in that the epitaxially grown silver chloride crystals are replaced with converted-halide silver halide crystals by converting at least a portion of the silver chloride to silver bromide using conventional techniques. Apart from introducing numerous internal disuniformities into the silver chloride crystal in the course of producing the converted-halide silver halide crystal in its place, the structure of the resulting composite silver halide grains are believed to remain essentially unalterred adjacent the epitaxial junction, but may be altered in their external configuration. The resulting composite grains appear similar in photomicrographs to those of the parent emulsion.

When blue light, for example, strikes an emulsion containing the composite crystals according to my invention, a developable internal latent image is formed. Since converted-halide silver halide is known to exhibit a limited absorption of blue light as compared to silver iodide, the latent image must be attributed to the photons striking the silver iodide crystal. In fact, the wedge spectrogram produced by the composite crystals match those of silver iodode. It is accepted that absorbed photons generate latent images by generating hole-electron pairs. In silver iodide crystals lacking epitaxially joined silver halide grains the hole-electron pairs do not result in a developable latent image being formed at normal coating silver ion concentrations. This is believed to be the result of hole-electron pair recombinations occurring within the silver iodide crystal. I have observed that the exposure of the silver iodide and converted-halide silver halide composite crystals in my emulsions can result in rendering the composite silver halide crystal developable at normal coating silver ion concentrations. The fact that the developable latent image is predominantly internal is further evidence that the latent image is formed within the converted-halide silver halide crystals.

From the above discussion it is apparent that it is the silver iodide crystal portion of the composite crystal which acts as the primary radiation receptor. In order to achieve acceptable photographic speeds employing the composite crystals for imaging purposes I contemplate that the mean diameter of the silver iodide crystals within the composite crystals will normally be at least 0.1 micron, preferably at least 0.2 micron. The maximum mean diameter of the silver iodide crystals can be as large as the largest silver halide grains conventionally employed in photography. For example, I contemplate using very large silver iodide crystals, up to about 4 microns in mean diameter, as is practiced in high speed radiographic applications. Still larger diameter crystals can be employed, although image definition will be necessarily less precise.

While it has previously been taught in the art to form composite silver halide grains by forming a shell over a core crystal structure, it is a significant feature of my invention that neither the silver chloride nor the converted-halide crystal form a shell on a silver iodide crystal with which it is epitaxially fused. At least half of the surface areas of the silver iodide crystals is free of epitaxial silver chloride, and epitaxial silver chloride is typically limited to 1, 2 or, occasionally, 3 facets of the silver iodide crystals. When the silver chloride or converted-halide reaches 75 mole percent of the total silver halide, encroachment of the silver choride or converted-halide crystal structure on the surfaces of the silver iodide crystal facets adjacent the crystal facet of the silver iodide at which epitaxial growth commenced can be observed. However, no shell is in evidence.

As is apparent from the above discussion, the epitaxial converted-halide silver halide crystals are not the primary radiation receptors of the composite crystals. Hence the speed of the emulsions is not controlled by the radiation striking the epitaxial converted-halide silver halide crystals. Viewed in a slightly different way, it is apparent that increasing the epitaxial converted-halide silver halide in proportion to the silver iodide can actually decrease the speed to silver halide ratio of an emulsion, rendering it less efficient in comparison to other emulsions of similar silver halide content. I attribute the high photographic speeds attainable by my emulsions as compared to emulsions of conventional core-shell silver halide grains to the specific combinations of silver halides and to the limited proportion of converted-halide silver halide crystals making up the composite crystals.

Generally the composite silver halide grains employed in my emulsions contain less than 75 mole percent converted-halide silver halide. (Unless otherwise stated, all epitaxial converted-halide silver halide mole percentages are based on total silver halide of the composite crystals.) This is a much lower proportion of silver halide than would be required to shell the silver iodide grain 1 with silver chloride. I generally prefer that the proportion of epitaxial converted-halide silver halide in the composite grains be less than 50 mole percent.

The minimum amount of epitaxial converted-halide silver halide required is only that required to assure its distribution among the host silver iodide crystals. Generally developable emulsions can be obtained with as little as 1 mole percent converted-halide silver halide. I generally prefer that the epitaxial converted-halide silver halide grains account for at least 5 mole percent of the composite crystals. The optimum proportion of converted-halide silver halide is dependent, of course, upon the specific application contemplated. Where high radiation exposure levels are contemplated and rapid developability is being sought, a somewhat higher proportion of epitaxial converted-halide silver halide can be efficiently employed than where low radiation exposure levels and less rapid development requirements are contemplated.

Unless specifically modified during formation, the epitaxial chloride crystal renders the composite silver chloride and silver iodide crystal responsive to surface development. That is, the composite silver halide crystal bearing a latent image can be developed in a surface developer. A surface developer is one which is substantially free of a soluble iodide salt or a silver halide solvent and is therefore only capable of initiating development of a latent image which lies at the surface of a silver halide grain. By contrast, an internal developer is a developer containing a silver halide solvent or soluble iodide salt or otherwise modified to permit access to the interior of a silver halide grain. On the other hand, the composite crystals of silver iodide and converted-halide silver halide form latent images on exposure which lie predominantly within the crystal structure rather than at its surface.

The converted-halide silver halide crystals forming a part of the composite epitaxial silver halide grains have a halide content of at least 50 mole percent and, preferably at least 80 mole percent, bromide and contain up to 10 mole percent iodide, any remaining halide being chloride. Especially good results are obtained with converted-halide silver halide crystals containing from about 85 to 95 mole percent bromide.

The composite converted-halide silver halide and silver iodide grains can be the sole silver halide grains present in an emulsion according to my invention. The composite grains can either be monodispersed or polydispersed. The term "monodispersed" is employed herein as defined in Illingsworth U.S. Pat. No. 3,501,305, issued Mar. 17, 1970. Namely, in order to be considered monodispersed, at least 95% by weight or by number of the composite silver halide grains must be within 40% of the mean diameter of the silver halide grains. The mean diameter is the average minimum diameter of the composite crystals. In FIG. 3, for example, this is the diameter measured along the fused bases of the truncated bypyramids forming the iodide crystal. The relative advantages of monodispersed and polydispersed emulsions are generally well understood in the art. For example, monodispersed emulsions exhibit higher contrast than corresponding polydispersed emulsions.

A preferred technique for forming a parent emulsion for producing a composite emulsion according to this invention is to form first the host silver iodide crystals, employing any conventional silver iodide emulsion forming technique. To a reaction vessel containing the silver iodide emulsion a chloride ion containing feedstock, such as an alkali chloride salt solution, e.g. in sodium or potassium chloride salt solution, and a silver ion containing feedstock, such as a silver nitrate solution, are separately added. The silver and chloride ion feedstocks can be of any conventional type employed in double jet silver chloride preparations. The necessary vehicle for emulsion formation is at least in part already in the reaction vessel dispersing the silver iodide crystals. Additional vehicle can be introduced along with either or both of the silver ion or chloride ion feedstocks or using a separate jet. The proportion of silver chloride in the final emulsion is determined by limiting the quantity of the silver and/or chloride ion introduced.

The techniques and parameters are well known in the art for favoring continued silver halide growth on an existing silver halide crystal, in this instance epitaxial deposition of silver chloride on the host silver iodide crystals, as compared with formation of new crystals. I have found that substantially all of the silver iodide host crystals can be converted to composite silver halide crystals, with little, if any, separate silver chloride crystal formation occurring by employing a double jet precipitation of silver chloride as described above and rapid introduction of silver and chloride ions. With reduced silver and chloride ion feed rates and/or lower silver iodide crystal concentrations, a mixture of composite silver halide crystals, silver iodide crystals and silver chloride crystals can result. Where the composite silver halide crystals are formed along with separate silver iodide and silver chloride crystals, conventional silver halide grain separation techniques can be employed to increase the proportion of the composite silver halide grains present. Alternatively, for many applications the emulsions can be employed directly as formed, as discussed below. While the composite silver halide grain preparation technique described above is preferred, other techniques are known to produce composite silver halide crystal structures useful as parent emulsions in preparing the composite converted-halide silver halide and silver iodide emulsions according to this invention and can be employed, if desired.

After the formation of the composite epitaxial silver chloride and silver iodide emulsion, a soluble bromide salt can be added to convert at least a portion of the silver chloride crystal, which is the most soluble silver halide, to silver bromide. If desired, a soluble iodide salt can also be added to form silver bromoiodide. Potassium bromide and potassium iodide are especially useful for this purpose. It is not essential to convert all of the silver chloride to silver bromide or silver bromoiodide, nor is it essential that the converted-halide silver halide grains contain iodide (although some iodide will usually be present, at least at the level of an impurity). The useful converted-halide silver halide grains thus include silver bromide, silver bromoiodide, silver chlorobromide and silver chlorobromoiodide. The method of converting the silver chloride grains in the parent composite emulsion of this invention can be accomplished by any conventional technique for producing a converted-halide silver halide emulsion. Preferred techniques are those disclosed by Davey and Knott U.S. Pat. No. 2,592,250 and Evans U.S. Pat. No. 3,622,318, cited above, each here incorporated by reference.

It is recognized in the art that silver halide emulsions can be tailored to achieve desired photographic properties by blending dissimilar emulsions. For example, exact control over speed and contrast to achieve a desired target is frequently obtained by this technique. I specifically contemplate that the composite silver halide grains of this invention can be combined with conventional silver halide grains in a blended silver halide emulsion. Any proportion of the composite silver halide grains can be usefully present in the blended emulsion which will produce an observable effect on photographic response. Where the composite silver halide grains are being relied upon primarily for imaging rather than the other silver halide grains blended therewith, I prefer that at least 50% by weight of the silver halide grains present be composite silver halide grains.

I specifically contemplate the convenient formation or blending of silver chloride grains with the composite silver halide grains according to my invention. A distinct advantage which can be obtained by blending silver chloride grains with the composite grains, in addition to those generally associated with blending, is that the speed and/or silver image density can be materially enhanced due to solution physical development of the silver chloride grains, even though these grains may not be directly or chemically developable under the contemplated conditions of exposure or processing. While widely varied proportions of composite silver halide grains and silver chloride grains can be usefully employed, depending upon the specific end use contemplated, to achieve distinct advantages through solution physical development I prefer to blend into the emulsion at least about 1 percent by weight silver chloride grains, preferably about 5 percent, but less than about 50 percent, based on total silver halide present in the emulsion. Physical development of silver halide emulsions is discussed by Mees and James, cited above, Chapter 15, "The Mechanism of Development."

The photographic emulsions described in the practice of this invention can contain various colloids alone or in combination as vehicles and binding agents. Suitable hydrophilic materials include both naturally occurring substances such as proteins, for example, gelatin, gelatin derivatives, cellulose derivatives, polysaccharides such as dextran, gum arabic and the like; and synthetic polymeric substances such as all water-soluble polyvinyl compounds like poly(vinylpyrrolidone), acrylamide polymers and the like.

The described photographic emulsions employed in the practice of this invention can also contain, alone or in combination with hydrophilic, water-permeable colloids, other synthetic polymeric compounds such as dispersed vinyl compounds such as in latex form and particularly those which increase the dimensional stability of the photographic materials. Suitable synthetic polymers include those described, for example in U.S. Pat. Nos. 3,142,568 by Nottorf issued July 28, 1964; 3,193,386 by White issued July 6, 1965; 3,062,674 by Houck et al, issued Nov. 6, 1962; 3,220,844 by Houck et al issued Nov. 30, 1965; 3,287,289 by Ream et al issued Nov. 22, 1966; and 3,411,911 by Dykstra issued Nov. 19, 1968; particularly effective are those water-insoluble polymers or latex copolymers of alkyl acrylates and methacrylates, acrylic acid, sulfoalkyl acrylates or methacrylates, those which have cross-linking sites which facilitate hardening or curing, those having recurring sulfobetaine units as described in Canadian Pat. No. 774,054 by Dykstra and those described in U.S. Pat. No. 3,488,708 by Smith issued Jan. 6, 1970. Conventional proportions of vehicles and binding agents in the emulsions are contemplated.

In addition to the composite converted-halide silver halide and silver iodide crystals and the vehicle, the emulsions according to my invention can contain a variety of conventional components, depending upon the desired photographic application intended. Typically, the silver halide emulsions according to my invention are coated onto a photographic support to form one or more layers of a photographic element.

*Product Licensing Index,* Vol. 92, Dec. 1971, publication 9232, here incorporated by reference, discloses various forms which the silver halide emulsions and the photographic elements in which they are employed can take, as well as techniques for their formation. Emulsion washing can be undertaken, as described in paragraph II; development modifiers can be incorporated, as described in paragraph IV; antifoggants and stabilizers can be incorporated, as described in paragraph V; developing agents can be incorporated, as described in paragraph VI; hardeners can be incorporated, as described in paragraph VII; antistatic layers can be incorporated, as described in paragraph IX; photographic supports can be employed, as described in paragraph X; plasticizers and lubricants can be employed, as described in paragraph XI; coating aids can be employed, as described in paragraph XII; brighteners can be employed, as described in paragraph XIV; spectral sensitization can be employed, as described in paragraph XV; and absorbing and filter dyes can be employed, as described in paragraph XVI; each noted paragraph forming part of the above-cited *Product Licensing Index* publication.

The photographic emulsions according to my invention are suited for use in forming photographic elements responsive to visible light, including cinematographic elements, radiographic elements which are exposed to X-rays through one or more intensifying screens, color photographic elements, black-and-white photographic elements, image-transfer photographic elements, high contrast photographic elements and the like.

The silver halide emulsions employed in the practice of invention can be chemically sensitized according to procedures well known to those skilled in the art. For example, the silver halide emulsions can be sensitized with chemical sensitizers, such as with reducing compounds; sulfur, selenium or tellurium compounds; gold, platinum or palladium compounds; or combinations of these. Procedures for chemically sensitizing silver halide emulsions are described in Sheppard et al U.S. Pat. No. 1,623,499 issued Apr. 5, 1927; Waller et al U.S. Pat. No. 2,399,083 issued Apr. 23, 1946; McVeigh U.S. Pat. No. 3,297,447 issued Jan. 10, 1967 and Dunn U.S. Pat. No. 3,297,446 issued Jan. 10, 1967.

The photographic elements according to my invention can be physically developed by conventional techniques. For example, physical development as disclosed by Agfa British Pat. No. 920,277, published Mar. 6, 1963; British Pat. No. 1,131,238, published Oct. 23, 1968 and Belgian Pat. No. 718,019, granted Jan. 13, 1969, is contemplated.

The photographic emulsions of this invention can be employed in conventional image transfer systems, if desired. Such systems are known to those skilled in the art. Colloid transfer systems are described in Yutzy et al U.S. Pat. Nos. 2,596,756 issued May 13, 1952 and 2,716,059 issued Aug. 23, 1953. Silver salt diffusion transfer systems are described in Rott U.S. Pat. No. 2,352,014 issued June 20, 1944; Land U.S. Pat. No. 2,543,181 issued Feb. 27, 1951; Yackel et al U.S. Pat. No. 3,020,155 issued Feb. 6, 1962 and Land U.S. Pat. No. 2,861,885, issued Nov. 25, 1958. Imbibition transfer systems are described in Minsk U.S. Pat. No. 2,882,156 issued Apr. 14, 1959. Color image transfer systems are described in Rogers U.S. Pat. Nos. 3,087,818 issued Apr. 30, 1963, 3,185,467 issued May 25, 1965, and 2,983,606 issued May 9, 1961; Weyerts et al U.S. Pat. No. 3,253,915 issued May 31, 1966; Whitmore et al U.S. Pat. No. 3,227,550 issued Jan. 4, 1966; Barr et al U.S. Pat. No. 3,227,551 issued Jan. 4, 1966; Whitmore et al U.S. Pat. No. 3,227,552, issued Jan. 4, 1966; Land U.S. Pat. Nos. 3,415,664, 3,415,645 and 3,415,646, all issued Dec. 10, 1968; Rogers U.S. Pat. Nos. 3,594,164 and 3,594,165 issued July 20, 1971; and Belgian Pat. Nos. 757,959 and 757,960 granted Apr. 23, 1971. Each of the image-transfer systems include an image-receiving means which receives and records at least a portion of each of the images formed in the photographic emulsion layer formed according to this invention.

Although specific modes of processing are elsewhere described, it is recognized that the photographic elements of this invention can be generally processed according to procedures well known to those skilled in the art. For example, conventional processing, such as disclosed in *Product Licensing Index*, cited above, paragraph XIII, is contemplated for use with my photographic elements.

The emulsions of my invention are fully suitable for use in redox amplification systems such as those which require a heterogeneous catalyst to permit the reaction of an oxidizing agent and a reducing agent. In such systems the developing agent reduces the silver halide to produce a silver image which can act as a heterogeneous catalyst. Typical oxidizing agents include transition metal complexes, such as cobalt(III) complexes, and peroxide oxidizing agents—e.g. cobalt hexammine and hydrogen peroxide. The reducing agents are color developing agents which upon oxidation react with color couplers to produce dye images or electron transfer agents which upon oxidation react with redox dye releasers to release dye imagewise. If silver halide development and the redox amplification reactions employing the developing silver as a catalyst surface occur simultaneously in a single processing solution, the epitaxial converted-halide silver halide crystals can be developed to silver catalyst without iodide ion poisoning of the catalyst surface. If, however, the redox amplification reaction is carried out in a separate processing bath subsequent to development of the composite silver halide, the catalytic silver is poisoned by iodide released during silver iodide development and no redox amplification occurs. With these stated qualifications, the silver halide emulsions can be generally applied to conventional redox amplification processes. The silver halide emulsions can be substituted, for example, for those disclosed in Matejec U.S. Pat. No. 3,674,490, issued July 4, 1972; Travis U.S. Pat. No. 3,765,991, issued Oct. 16, 1973; Dunn et al U.S. Pat. No. 3,822,129, issued July 2, 1974; Bissonette et al U.S. Pat. No. 3,847,619, issued Nov. 12, 1974; Bissonette U.S. Pat. No. 3,834,907, issued Sept. 10, 1974; Bissonette U.S. Pat. No. 3,902,905, issued Sept. 2, 1975; Mowrey U.S. Pat. No. 3,904,413, issued Sept. 9, 1975; and Bissonette U.S. Pat. No. 3,923,511, issued Dec. 2, 1975; the disclosures of which are here incorporated by reference.

Because of their iodide content the emulsions and elements of my invention can be employed in redox amplification systems in which a heterogeneous catalyst is poisoned in an imagewise manner. A redox amplification system capable of forming reversal images which utilizes iodide ions to imagewise poison developed silver is disclosed in *Research Disclosure*, Vol. 148, Item 14836, published August 1976. The composite silver halide crystals can be employed in the emulsions therein disclosed in lieu of the conventional silver haloiodide grains.

I specifically contemplate the use of the composite silver halide crystals in lieu of conventional silver halide grains in photographic elements which are heat processed—i.e., photothermographic elements. Such elements are comprised of a support and a radiation-sensitive layer including an oxidation-reduction image-forming combination comprising a reducing agent and a heavy metal salt oxidizing agent. The composite silver halide grains act as a catalyst for the oxidation-reduction image-forming combination upon exposure and processing. The radiation-sensitive layer additionally includes a photographic vehicle, such as gelatin, which acts as a binder. The composite silver halide crystals can be incorporated in conventional photothermographic elements, such as those described in Morgan et al U.S. Pat. No. 3,547,075, issued July 22, 1969; Shepard et al U.S. Pat. No. 3,152,904, issued Oct. 13, 1964; Yutzy and Yackel U.S. Pat. No. 3,392,020, issued July 9, 1968; Sullivan et al U.S. Pat. No. 3,785,830, issued Jan. 15, 1974 and Sutton et al U.S. Pat. No. 3,893,860, issued July 8, 1975.

Further, although I have described my composite crystals for use in silver halide emulsions, they can be employed in lieu of conventional silver halide crystals in any conventional silver halide photographic element.

The following examples are intended to further illustrate my invention:

EXAMPLE 1

A monodispersed gelatino-silver iodide emulsion was prepared by a conventional double jet precipitation technique. The silver iodide emulsion had a weight of 1.31 kilograms per mole of silver and contained 20 grams of gelatin per mole of silver. The silver iodide grains were predominantly beta-phase silver iodide crystals having a mean diameter in the range of from 0.25 to 0.30 micron. The beta-phase silver iodide crystals were hexagonal bypyramids.

To prepare a composite epitaxial emulsion of silver iodide and silver chloride grains two solutions were prepared as indicated below:

| Solution A | | |
|---|---|---|
| $AgNO_3$ | 17.479 | g |
| Distilled Water | 1400.0 | ml |
| Deionized Bone Gelatin | 140.0 | g |
| AgI Emulsion (composition listed above) | 539.0 | g |
| Temperature | 35° C. | |
| **Solution B** | | |
| 0.5 Molar Solution of NaCl | 226.38 | ml |

-continued

| Room Temperature |
|---|

Solution B was added in less than one second to Solution A with rapid agitation. Distilled water (1.26 liters) was added to obtain 6.92 Kg emulsion/mole Ag at pAg 6.85.

EXAMPLE 2

To the emulsion of Example 1 at 40° C. was added one ml of a $2.06 \times 10^{-3}$ molar potassium bromide solution. The mixture was heated at a rate of 1.67° C. per minute to 60° C., mixed with 2 grams of phthalated gelatin, held for 35 minutes at 60° C., combined with 140 grams of distilled water, cooled to 40° C. and adjusted to a pH of 3.7 to cause coagulation. The coagulum was washed and combined with 50 grams of deionized bone gelatin. The pH and pAg were adjusted to 7.0 and 8.0, respectively.

Electron micrographs showed silver iodide grains having surface grain protrusions similar in appearance to those provided by the silver chloride grains epitaxially grown on the host silver iodide grains. Chemical analysis of the composite epitaxial emulsion revealed 81.5 percent silver iodide, 17.0 percent silver bromide and about 1.5 percent silver chloride, on a mole basis. X-ray analysis indicated that the emulsion appeared to be predominantly made up of beta-phase silver iodide and a complex mixture of silver chloride, silver bromide and silver iodide.

EXAMPLE 3

A sample of the emulsion of Example 2 was coated on a film support at 0.45 grams of silver per square meter and 3.58 grams of gelatin per square meter. The dried coating was exposed for one-half second to tungsten light through a wedge spectrograph and processed in a surface developer of the composition set out in Table I to provide a faint image with an absorption spectrum characteristic of silver iodide.

TABLE I

| Surface Developer | |
|---|---|
| para-Methylaminophenol sulfate | 2.5 g |
| Ascorbic Acid | 10.0 g |
| Sodium Bromide | 2.0 g |
| Sodium meta-borate | 35.0 g |
| Distilled Water to | 1.0 liter |
| pH | 9.8 |

EXAMPLE 4

A sample of the emulsion of Example 2 was coated and processed as in Example 3, except that 3 grams per liter of sodium thiosulfate pentahydrate was added to the developer to convert the developer to an internal developer. A higher maximum density photographic image was obtained as compared to Example 3 with an absorption spectrum characteristic of silver iodide and with a longer wavelength portion believed to be due to silver chlorobromoiodide.

EXAMPLE 5

Example 3 was repeated, except that prior to development the sample was surface bleached for 5 minutes in $K_4Fe(CN)_6$. The surface bleaching removed the surface latent image so that no image was developed in the surface developer.

EXAMPLE 6

Example 5 was repeated; the developer was converted to an internal developer by the addition of 3 grams per liter of sodium thiosulfate pentahydrate. The photographic result was similar to that of Example 4.

Sensitometric comparisons of the photographic results obtained in Examples 3 through 6 indicated that the internal sensitivity of the composite epitaxial silver halide was about 1.0 log E faster than the surface sensitivity.

EXAMPLE 7

To illustrate the applicability of the emulsions of this invention to photothermographic systems, a sample of the emulsion prepared according to Example 2 was employed to form a photothermographic system according to Sullivan, Cole and Humphlett U.S. Pat. No. 3,785,830, issued Jan. 15, 1974.

A first composition, Composition A, was prepared by ball-milling for about 12 hours the following components:

| | |
|---|---|
| 3-(2-carboxyethyl)-4-hydroxy-methyl-4-thiazoline-2-thione | 4.0 g |
| silver trifluoroacetate | 1.75 g |
| water | 30.0 ml |

A control coating melt was prepared by mixing the following components:

| | |
|---|---|
| Composition A | 7.0 ml |
| Hydroquinone, 5 percent in water | 2.0 ml |
| A conventional gelatino-silver iodide emulsion containing 3 to 6 milligrams of silver | 0.2 ml |
| Surfactant, 0.5 percent by weight in water | 0.2 ml |

An identical coating melt was prepared by substituting for the conventional gelatino-silver iodide emulsion an emulsion prepared according to Example 2.

The coating melts were spearately coated on polyethylene coated paper supports at a thickness of 100 microns and air dried. The resulting photothermographic elements were exposed sensitometrically to tungsten light through a step tablet and processed by overall heating at 150° C. to 180° C. for 30 seconds to 5 seconds. This produces a brown to nearly neutral tone image with the tone depending upon processing temperature. The higher processing temperatures provide more neutral tone images. The background of the image is off-white. The processed elements exhibited virtually no post processing printup.

The comparative performance of the photothermographic elements is set out in Table II. It can be seen that the composite epitaxial emulsions are considerably faster and exhibit a lower contrast, a comparable minimum density and a lower maximum density.

TABLE III

| Emulsion | *Relative Speed | Contrast | Dmin | Dmax |
|---|---|---|---|---|
| Control AgI | 100 | 0.81 | 0.10 | 1.12 |
| Example 2 | 412 | 0.29 | 0.10 | 0.70 |

*measured at 0.10 above $D_{min}$

The term "epitaxial" as applied to the composite silver chloride-silver iodide crystals or grains is employed in its accepted usage to mean that the crystallographic orientation of the silver and chloride atoms of the crystals are controlled by the crystalline substrate, the silver iodide crystals, on which they are grown. The epitaxial relationship of the silver chloride and silver iodide portions of the composite crystals is then quite distinct from direct physical contact of separate silver iodide and silver chloride crystals, even if emulsion peptizer did not interfere. When the silver chloride portion of the composite crystals are converted to a converted-halide silver halide crystal structure, the crystallographic orientation of the resulting crystal is controlled by the parent silver chloride crystal, although a substantial degree of internal dislocations are introduced. Thus the converted-halide silver halide crystals are also in an epitaxial relationship to the silver iodide host crystals.

*Product Licensing Index* and *Research Disclosure,* both cited above, are published by and available from Industrial Opportunities Ltd., Homewell, Havant Hampshire, P09 1EF, United Kingdom.

The invention has been described with particular reference to preferred embodiments thereof but it will be understood that variations and modifications can be effected within the spirit and scope of the inventions.

I claim:

1. A converted-halide photographic emulsion comprised of a photographic vehicle as a continuous phase and, as a discrete phase, radiation-sensitive composite silver halide crystals comprised of multi-faceted, radiation-receptive silver iodide crystals, converted-halide silver halide crystals at least partially converted from silver chloride to silver bromide forming epitaxial junctions with the silver iodide crystals, at least half of the facets of the silver iodide crystals being substantially free of epitaxial silver chloride, and the converted-halide silver halide crystals being limited to less than 75 mole percent, based on the total silver halide forming the composite crystals.

2. A converted-halide photographic emulsion according to claim 1 wherein said converted-halide silver halide crystals are comprised of at least 50 mole percent bromide.

3. A converted-halide photographic emulsion according to claim 2 wherein said converted-halide silver halide crystals are comprised of silver chloride, silver bromide and silver iodide.

4. A converted-halide photographic emulsion according to claim 3 wherein said converted-halide silver halide crystals are comprised of at least 80 mole percent silver bromide and less than 5 mole percent silver iodide, the remainder being silver chloride.

5. A converted-halide photographic emulsion according to claim 1 wherein said silver iodide crystals are predominantly beta-phase silver iodide present in the form of truncated bipyramid crystals.

6. A converted-halide photographic emulsion according to claim 1 wherein the silver iodide crystals have a minimum mean diameter of at least 0.1 micron.

7. A converted-halide photographic emulsion according to claim 1 wherein at least 1 percent on a mole basis of the total composite silver halide crystals present are converted-halide silver halide crystals.

8. A converted-halide photographic emulsion according to claim 1 wherein at least 5 percent on a mole basis of the total composite silver halide crystals present are converted-halide silver halide crystals.

9. A converted-halide photographic emulsion according to claim 1 wherein less than 50 percent, on a mole basis, of the total composite silver halide crystals present are converted-halide silver halide.

10. A converted-halide photographic emulsion according to claim 1 wherein the emulsion is a photothermographic emulsion containing additionally an oxidation-reduction imaging combination comprised of a reducing agent and a heavy metal salt oxidizing agent.

11. A converted-halide silver halide photographic emulsion comprised of a photographic vehicle as a continuous phase and, as a discrete phase, radiation-sensitive composite silver halide crystals each comprised of beta-phase truncated bipyramid silver iodide crystals having a minimum mean diameter of at least about 0.2 micron, in each composite crystal at least one converted-halide silver halide crystal forming an epitaxial junction with the silver iodide crystal, at least half of the facets of the silver iodide crystal being substantially free of epitaxial converted-halide silver halide and the converted-halide silver halide crystals being limited to from 1 to less than 50 mole percent, based on the total silver halide forming the composite silver halide crystals, the converted-halide silver halide crystals being comprised of at least 80 mole percent silver bromide and less than 5 mole percent silver iodide, the remainder being silver chloride.

12. In a photographic element comprised of a support and, as a coating on the support, a radiation-sensitive layer including radiation-sensitive silver halide crystals, the improvement wherein at least a portion of the radiation-sensitive silver halide crystals are composite silver halide crystals comprised of multi-faceted, radiation-receptive silver iodide crystals, converted-halide silver halide crystals at least partially converted from silver chloride to silver bromide forming epitaxial junctions with the silver iodide crystals, at least half of the facets of the silver iodide crystals being substantially free of epitaxial silver chloride, and the converted-halide silver halide crystals being limited to less than 75 mole percent, based on the total silver halide forming the composite crystals.

13. In a photographic element according to claim 12 the further improvement wherein said converted-halide silver halide crystals comprise at least 1 percent and less than 50 percent, on a mole basis, of the total composite silver halide crystals present.

14. In a photographic element according to claim 12 the further improvement wherein said converted-halide silver halide crystals are comprised of at least 80 mole percent silver bromide and less than 5 mole percent silver iodide, the remainder being silver chloride.

15. In a photographic element according to claim 12 the further improvement wherein the silver iodide crystals are beta-phase silver iodide crystals and have a minimum mean diameter of at least 0.2 micron.

16. In a photographic element according to claim 12 the further improvement wherein the element is a photothermographic element containing additionally an oxidation-reduction imaging combination comprised of a reducing agent and a heavy metal salt oxidizing agent.

17. In a photographic element comprised of a support and, as a coating on the support, a radiation-sensitive layer including radiation-sensitive silver halide crystals, the improvement wherein at least a portion of the radiation-sensitive silver halide crystals are composite silver halide crystals each comprised of beta-phase truncated bipyramid silver iodide crystals having a minimum mean diameter of at least about 0.2 micron, in each composite crystal at least one converted-halide silver halide crystal forming an epitaxial junction with the silver iodide crystal, at least half of the facets of the silver iodide crystal being substantially free of epitaxial converted-halide silver halide and the converted-halide silver halide crystals being limited to from 5 to less than 50 mole percent, based on the total silver halide forming the composite silver halide crystals, and the converted-halide silver halide crystals being comprised of at least 80 mole percent silver bromide and less than 5 mole percent silver iodide, the remainder being silver chloride.

18. In a photographic element according to claim 17 the further improvement wherein the element is a photothermographic element containing additionally an oxidation-reduction imaging combination comprised of a reducing agent and a heavy metal salt oxidizing agent.

19. In a photographic element according to claim 18 the further improvement wherien the heavy metal salt oxidizing agent is a silver salt of a thiazoline-2-thione and the reducing agent is a hydroquinone.

* * * * *